US005566878A

United States Patent [19]

Peiffer et al.

[11] Patent Number: 5,566,878

[45] Date of Patent: Oct. 22, 1996

[54] CARTON CONTRUCTION

[75] Inventors: Norman A. Peiffer, Maumee; Victor R. Simonyi, Lyndhurst, both of Ohio

[73] Assignee: The Andersons, Inc., Maumee, Ohio

[21] Appl. No.: 412,301

[22] Filed: Mar. 28, 1995

[51] Int. Cl.[6] ..... B65D 5/468

[52] U.S. Cl. ..... 229/117.16; 229/120.15; 229/120.18

[58] Field of Search ..... 229/117.12, 117.13, 229/117.16, 120.15, 120.18, 122, 215

[56] References Cited

U.S. PATENT DOCUMENTS

| | | | |
|---|---|---|---|
| 1,668,800 | 5/1928 | Bonfield . | |
| 1,898,231 | 2/1933 | Weiss | 229/120.18 |
| 2,643,811 | 6/1953 | Bolding | 229/120.18 X |
| 2,803,390 | 8/1957 | MacKay . | |
| 2,913,101 | 11/1959 | Daily | 229/120.15 |
| 3,025,630 | 3/1962 | Silvey . | |
| 3,106,331 | 10/1963 | Blackburn | 229/120.18 |
| 3,208,079 | 9/1965 | St. John . | |
| 3,302,847 | 2/1967 | Hennessey . | |
| 3,554,402 | 1/1971 | Lock . | |
| 3,667,458 | 6/1972 | Krebs . | |
| 4,103,770 | 8/1978 | Brandenburger et al. . | |
| 4,143,803 | 3/1979 | Taylor | 229/120.18 X |
| 4,284,205 | 8/1981 | Hirata | 229/117.12 X |
| 4,327,861 | 5/1982 | Thompson | 229/117.12 |
| 4,846,396 | 7/1989 | Palazzolo | 229/117.12 |
| 4,953,781 | 9/1990 | Bryan | 229/215 X |
| 4,979,657 | 12/1990 | Espiritu . | |
| 4,981,217 | 1/1991 | Lim . | |
| 5,000,375 | 3/1991 | Farber et al. | 229/117.12 |
| 5,292,059 | 3/1994 | Oliff | 229/117.16 |
| 5,361,898 | 11/1994 | Gottlieb | 229/120.18 |

FOREIGN PATENT DOCUMENTS

| | | | |
|---|---|---|---|
| 986657 | 3/1965 | United Kingdom | 229/117.12 |

*Primary Examiner*—Allan N. Shoap
*Assistant Examiner*—Christopher T. McDonald
*Attorney, Agent, or Firm*—Gifford, Krass, Groh, Sprinkle, Patmore, Anderson & Citkowski, P.C.

[57] ABSTRACT

A carton is provided for a fluent solid material in which the carton has a handle formed along one side, and a dispensing opening is provided at the top of an opposed side.

2 Claims, 1 Drawing Sheet

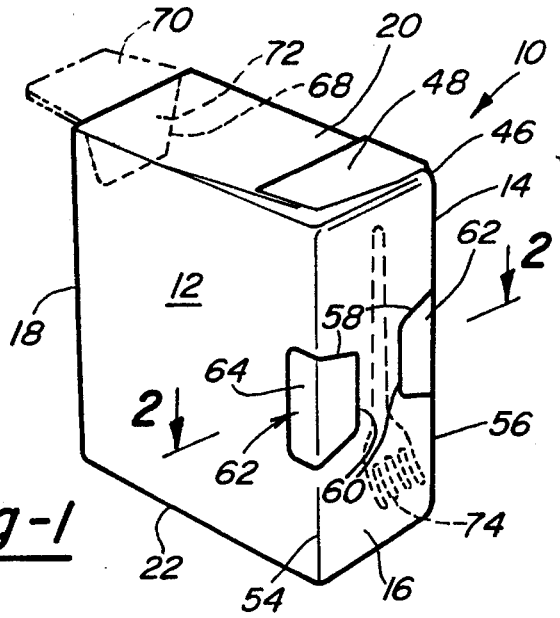
Fig-1
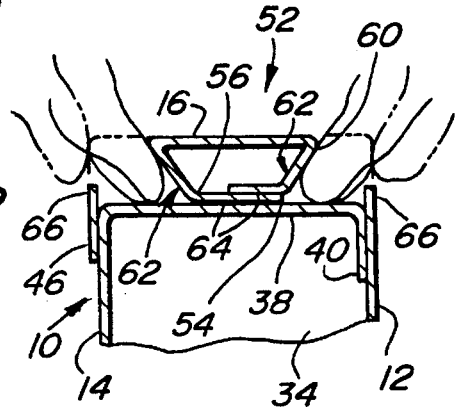
Fig-3
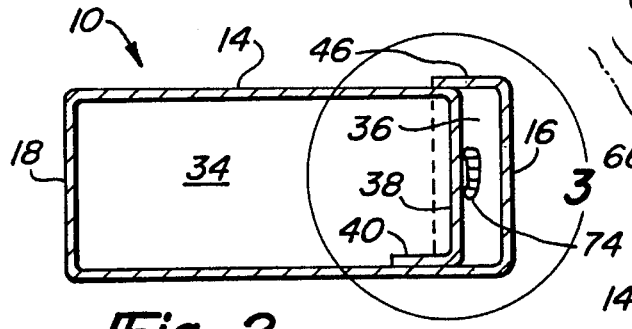
Fig-2
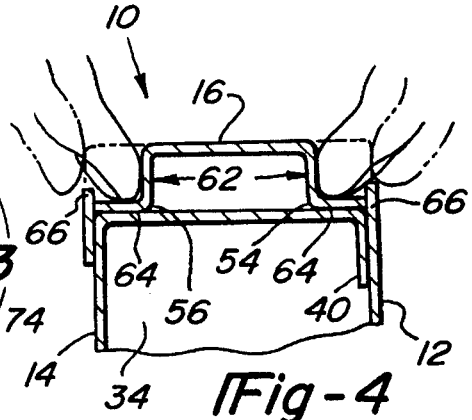
Fig-4
Fig-5
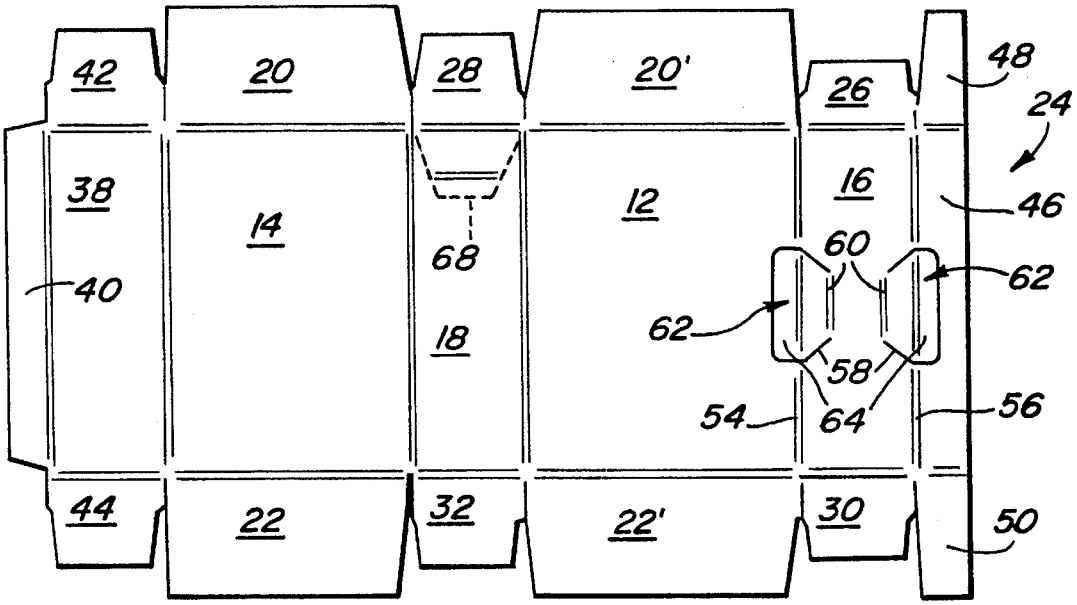

CARTON CONTRUCTION

BACKGROUND OF THE INVENTION

1. Field of the Invention

The present invention relates to a carton construction, and, more particularly, this invention relates to an improved carton construction in which the consumer can form a handle and pouring opening at scored areas on the carton.

2. State of the Art

Consumer cartons are sometimes supplied with prepunched or scored areas which serve as handle cutouts. Probably the most familiar examples are in the multibottle or multican cartons which house beverages and which can also be used for returning containers. Occasionally, a carton may have a tab or handle portion with a cutout for display hanging purposes.

With fluent solid products such as laundry detergents, the carton may be scored to provide a dispensing opening; for example, scoring may be provided to aid in folding back a portion of the carton top to provide such an opening.

While it is common to provide a handle and a dispensing orifice or nozzle in molded bottles, there are no equivalents in cartons for dispensing fluent solid products—probably largely the result of the paradigm that handle cutouts or tabs must be formed at the top of the carton, and the necessity of maintaining carton integrity to avoid spillage makes such a combination impractical.

SUMMARY OF THE INVENTION

The present invention features a carton with scoring to provide a handle along one of the sides of the carton. This is accomplished by supplying a divider panel adjacent one of the carton side panels to provide a small volume auxiliary compartment which accommodates the handle formation without affecting the integrity of the large volume product compartment. Such an auxiliary compartment can be utilized for housing companion products or coupons for discounts or premium redemptions. For example, in a carton for cat litter, the auxiliary compartment can contain a litter scoop and/or printed material.

A dispensing orifice is formed in the side opposite the handle side at the top. The carton is easily grasped with one hand at the handle for tilting and pouring the contents out of the dispensing orifice.

DRAWING

The advantages of the present invention will be more apparent from the following detailed description when considered in connection with the accompanying drawing wherein:

FIG. 1 is a perspective view of the carton of this invention;

FIG. 2 is a vertical section taken along line 2—2 of FIG. 1;

FIG. 3 is an enlarged view taken in the encircled area 3 of FIG. 2 showing the formation of the handle openings by pushing a serrated area inwardly into the auxiliary compartment of the carton;

FIG. 4 is an enlarged view similar to FIG. 3 showing an alternate way the handle openings can be pushed inwardly into the auxiliary compartment of the carton; and FIG. 5 is a plan view of the blank paperboard as it has been cut serrated and creased for forming the carton of the invention.

DETAILED DESCRIPTION OF THE PREFERRED EMBODIMENT

Referring to FIG. 1, the carton 10 of this invention is particularly suited for storage and dispensing a fluent solid material such as a cat litter product manufactured according to U.S. Pat. Nos. 5,064,407 and 5,062,954 to provide a granular product. Cat litter and other granular consumer products such as household detergents, cereals and the like, are conventionally supplied in rectangular boxes which can be cumbersome in handling to dispense the product from the box.

The carton 10 of this invention, like other prior art cartons, is filled and shipped as a rectangular carton or box having parallel front and back panels 12 and 14, first and second side panels 16 and 18 and top and bottom panels 20 and 22.

The carton 10 is formed from a single sheet 24 of paper board or other flat stiffened material which is blank cut, creased and perforated or scored as shown in FIG. 5. The sheet 24 is then folded and glued to form the finished carton 10. The top has overlapping outside and inside panels 20 and 20' along with top side flaps 26 and 28, and the bottom has overlapping outside and inside panels 22 and 22" along with bottom side flaps 30 and 32, all as conventional cartons or boxes. The finished carton 10 has a fully enclosed or sealed product compartment 34.

A small auxiliary compartment 36 is formed in the carton 10 of the invention by divider panel 38 and adjacent glue panel 40 along with top and bottom divider flaps 42 and 44. Additionally, a supplemental panel 46 overlaps and completes the width of back panel 14, and the supplemental panel or back panel portion 46 has overlapping top and bottom flaps 48 and 50.

A handle 52 is located at midpoint in one of the side panels 16 formed by die cutting adjacent front and back edge folds 54 and 56 along a die cut line 58 which extends into front and rear panels 12 and 14. Side panel 16 is also scored along parallel lines to form fold hinges 60 which keep the resulting handle tabs 62 permanently attached. Fold score lines along the front and back edges 54 and 56 allow the handle tabs 62 to be folded as they are pushed in as shown in FIGS. 3 and 4. Spaced nicks in die cut lines 58 maintain the box integrity until the consumer pushes in the tabs 62 to complete the formation of handle 52. The die cuts 58 allow the consumer to push in the tabs 62 with a minimum of effort while still maintaining this preformation integrity.

When the consumer pushes the handle tabs 62 inwardly, the free portions 64 of the tabs will normally fold inwardly toward each other as shown in FIG. 3. However, when the consumer pushes the handle tabs 62 inwardly, the free portions 64 can also fold outwardly as shown in FIG. 4. The die cuts 58 are positioned to leave outstanding edges 66 to retain the outward edges of the free tab portions 64 as seen in FIG. 4.

While the preferred embodiment of the handle 52 is formed with push in handle tabs 62 which are formed as part of the side panel 16 and front and rear panels 12 and 14, with narrower cartons, the handles can be formed with push in tabs only in the front and rear panels which would occupy the area of the free tab portions 64.

Side panel 18, opposite to the handle containing side panel 16, is perforated at 68 to form a flap 70 which can be pushed inwardly or removed to form a dispensing opening 72 adjacent the top panel 20. The carton is easily grasped with one hand, the handle 52 providing thumb and finger recesses on opposite sides of a palm engaging portion of the side panel. The carton can then be tilted to pour the contents out of the dispensing opening 72.

The auxiliary compartment not only provides a volume to form a carton handle which does not effect the integrity of the product compartment, but it also provides the space for housing special premiums and printed matter such as product literature and coupons. In the carton 10 illustrated for use with a pulverulent cat litter product, a litter scoop 74 is shown housed in the auxiliary compartment 36.

We claim:

1. A paper board carton for storage and dispensing a fluent solid product, said carton being formed from a sheet of paper board by blank cutting, forming cut lines, scoring, folding and gluing, said carton comprising:

parallel front and back panels;

a pair of parallel first and second side panels connecting said front and back panels;

parallel top and bottom panels connecting said front and back panels and said first and second side panels to form a finished closed carton;

a divider panel parallel to said first and second side panels adjacent to said first side panel and attached to said top and bottom panels to form with said first side panel a smaller auxiliary compartment and to form with said second side panel, a larger product compartment, said auxiliary and product compartments being isolated from each other by said divider panel;

said front, first side, and back panels having cut lines defining areas intermediate said top and bottom panels to produce, when said areas are punched and pushed inwardly to penetrate into said auxiliary compartment, a carton handle; and a panel having cut lines defining an area when punched into said product compartment forming a pouring opening.

2. A paper board carton for storage and dispensing a fluent solid product, said carton being formed from a sheet of paper board by blank cutting, forming cut lines, scoring, folding and gluing, said carton comprising:

parallel front and back panels;

a pair of parallel first and second side panels connecting said front and back panels;

parallel top and bottom panels connecting said front and back panels and said first and second side panels to form a finished closed carton; and a divider panel parallel to said first and second side panels adjacent to said first side panel and attached to said top and bottom panels to form with said first side panel a smaller auxiliary compartment and to form with said second side panel a larger product compartment, said auxiliary and product compartment being isolated from each other by said divider panel;

said front and first side panels having cut lines defining a first area and said back and first side panels having cut lines defining a second area, said first and second areas being intermediate said top and bottom panels to produce, when punched inwardly into to penetrate said auxiliary compartment, and form thumb and finger apertures into said auxiliary compartment on opposite sides of a palm engaging handle portion of said first side panel; and a panel having cut lines defining an area when punched into said product compartment forming a pouring opening;

whereby said auxiliary compartment can be used for containing related items and premiums and said carton can be conveniently grasped with a single hand at said handle portion for dispensing product through said pouring opening.

* * * * *

UNITED STATES PATENT AND TRADEMARK OFFICE

CERTIFICATE OF CORRECTION

PATENT NO. : 5,566,878

DATED : October 22, 1996

INVENTOR(S) : Norman A. Peiffer and Victor R. Simonyi

It is certified that error appears in the above-indentified patent and that said Letters Patent is hereby corrected as shown below:

On the title page, item [54], change "CONTRUCTION" to --CONSTRUCTION--.

Column 1, line 1, in the title change "CONTRUCTION" to --CONSTRUCTION--.

Column 2, line 29, before "along" delete --22"-- and insert --22' --.

Signed and Sealed this

Thirteenth Day of May, 1997

Bruce Lehman

*Attest:*

BRUCE LEHMAN

*Attesting Officer*

*Commissioner of Patents and Trademarks*